US007418972B2

(12) United States Patent
Reeves

(10) Patent No.: US 7,418,972 B2
(45) Date of Patent: Sep. 2, 2008

(54) MAGNETIC ATTACHMENT FOR A WALKING CANE

(76) Inventor: Timothy Reeves, 2105 2nd Ave., Los Angeles, CA (US) 90018

( * ) Notice: Subject to any disclaimer, the term of this patent is extended or adjusted under 35 U.S.C. 154(b) by 0 days.

(21) Appl. No.: 11/599,094

(22) Filed: Nov. 14, 2006

(65) Prior Publication Data

US 2007/0107760 A1 May 17, 2007

Related U.S. Application Data

(60) Provisional application No. 60/597,187, filed on Nov. 15, 2005.

(51) Int. Cl.
*A45B 3/00* (2006.01)

(52) U.S. Cl. ..... 135/66; 135/72; 135/79; 294/24

(58) Field of Classification Search ..... 135/65, 135/66, 70, 78–79, 84, 72; 294/24, 19.1, 294/19.3, 65.5, 104, 170
See application file for complete search history.

(56) References Cited

U.S. PATENT DOCUMENTS 4,017,082 A * 4/1977 Channing et al. ..... 473/285
4,291,736 A * 9/1981 Robertson et al. ..... 81/24
5,011,150 A * 4/1991 Averill ..... 473/284
5,178,048 A * 1/1993 Matechuk ..... 81/125
5,392,800 A * 2/1995 Sergi ..... 135/65
5,487,576 A * 1/1996 DuVivier ..... 294/19.1
5,704,674 A * 1/1998 Boozer ..... 294/65.5
5,945,901 A * 8/1999 Coleman et al. ..... 335/285
5,999,074 A * 12/1999 Coleman et al. ..... 335/285
6,065,787 A * 5/2000 Jarosch ..... 294/19.1
6,733,397 B1 * 5/2004 Barrett ..... 472/82
6,951,224 B2 * 10/2005 Garrett ..... 135/66
2006/0266397 A1 * 11/2006 Berl ..... 135/70

FOREIGN PATENT DOCUMENTS

FR 2685197 A1 * 6/1993

* cited by examiner

*Primary Examiner*—Winnie Yip
(74) *Attorney, Agent, or Firm*—Morland C. Fischer

(57) ABSTRACT

A magnetic attachment is disclosed to be coupled to a conventional walking cane at the handle end thereof that is grasped by the hand of a user. By turning the cane upside down, the magnetic attachment at the handle end can be moved into contact with a magnetic object (e.g., a set of keys) to be lifted off the floor and carried to the hand of the user. By virtue of the foregoing, an elderly or disabled individual will not have to bend over or kneel down to retrieve his dropped keys, or the like. In a first embodiment, the magnetic attachment is a coupling ring that is molded over and around a magnet. The coupling ring has a longitudinally extending channel that is sized to removably receive and surround the handle end of the walking cane. In a second embodiment, the magnetic attachment is a magnet that is retained within a hole that extends laterally through the handle end of the cane.

3 Claims, 2 Drawing Sheets

MAGNETIC ATTACHMENT FOR A WALKING CANE

CROSS-REFERENCE TO RELATED U.S. PATENT APPLICATIONS

This patent application is related to Provisional Patent Application No. 60/597,187 filed Nov. 15, 2005.

BACKGROUND OF THE INVENTION

1. Field of the Invention

This invention relates to a magnetic attachment coupled to the handle end of a conventional walking cane by which to enable elderly or disabled individuals to retrieve dropped metal objects, such as a set of keys, or the like, without having to bend over or kneel down.

2. Background Art

Individuals who are elderly or disabled, including those who may have suffered a physical injury, are often required to use a walking cane when moving from place to place. Because of age, infirmity, or disability, it is sometimes difficult for these individuals to retrieve various objects (e.g., a set of keys, or the like), that has fallen on the floor. In particular, having to bend over or kneel down to recover a fallen object may not be possible in some cases. In other cases, individuals could fall over or sustain back injury during the attempt to pick up an object which has been inadvertently dropped on the floor. Gripping and lifting devices have been associated with walking sticks to enable elderly and disabled users to retrieve fallen objects. Examples of such devices are available by referring to one or more of the following United States patents:

| U.S. Pat. No. | Issue Date |
|---|---|
| 3,591,226 | Jul. 6, 1971 |
| 5,392,800 | Feb. 28, 1995 |
| 5,640,985 | Jun. 24, 1997 |
| 6,550,400 | Apr. 22, 2003 |

However, the devices shown in the above-identified patents are generally complex, relatively expensive and require manipulative skills. Consequently, such devices may not be readily available or suitable to many of those in need of a lifting aid.

Accordingly, what is needed is an effective, inexpensive, and simple-to-use device that can be coupled to the walking cane of an elderly or disabled individual to enable him to retrieve dropped magnetic objects without exerting any special manipulative skills or having to bend over or kneel down.

SUMMARY OF THE INVENTION

In general terms, disclosed herein is a magnetic attachment to be quickly and easily coupled to a conventional walking cane of the type having a handle at the top end thereof to be grasped in the hand of an elderly or disabled individual. More particularly, the magnetic attachment includes a magnet that is coupled to the handle end of the walking cane. By turning the cane upside down, the magnetic attachment at the handle end can be moved into contact with a magnetic object, such as a set of keys, or the like. The magnet of the magnetic attachment exerts an attractive force to hold the magnetic object against the handle end of the cane so that the object can be lifted off the floor and carried to the user's hand. By virtue of the foregoing, the user will not have to bend over or kneel down to retrieve an object which has inadvertently fallen on the floor.

According to a first preferred embodiment, the magnetic attachment is a coupling ring having a cylindrical coupling channel running longitudinally therethrough. The coupling channel is sized to slidably receive the handle end of the cane by which the magnetic attachment is removably connected to and carried with the cane. The coupling ring in this embodiment is a (e.g., silicone rubber) material that is molded over and around a magnet which provides the attractive force to hold the magnetic object against the cane.

According to a second preferred embodiment, the magnetic attachment is a magnet that is fixedly connected to and carried with the cane to provide the attractive force. In this case, the magnet is retained within a hole that is formed laterally through the handle end of the cane.

DESCRIPTION OF THE PREFERRED EMBODIMENT

Figure 1:
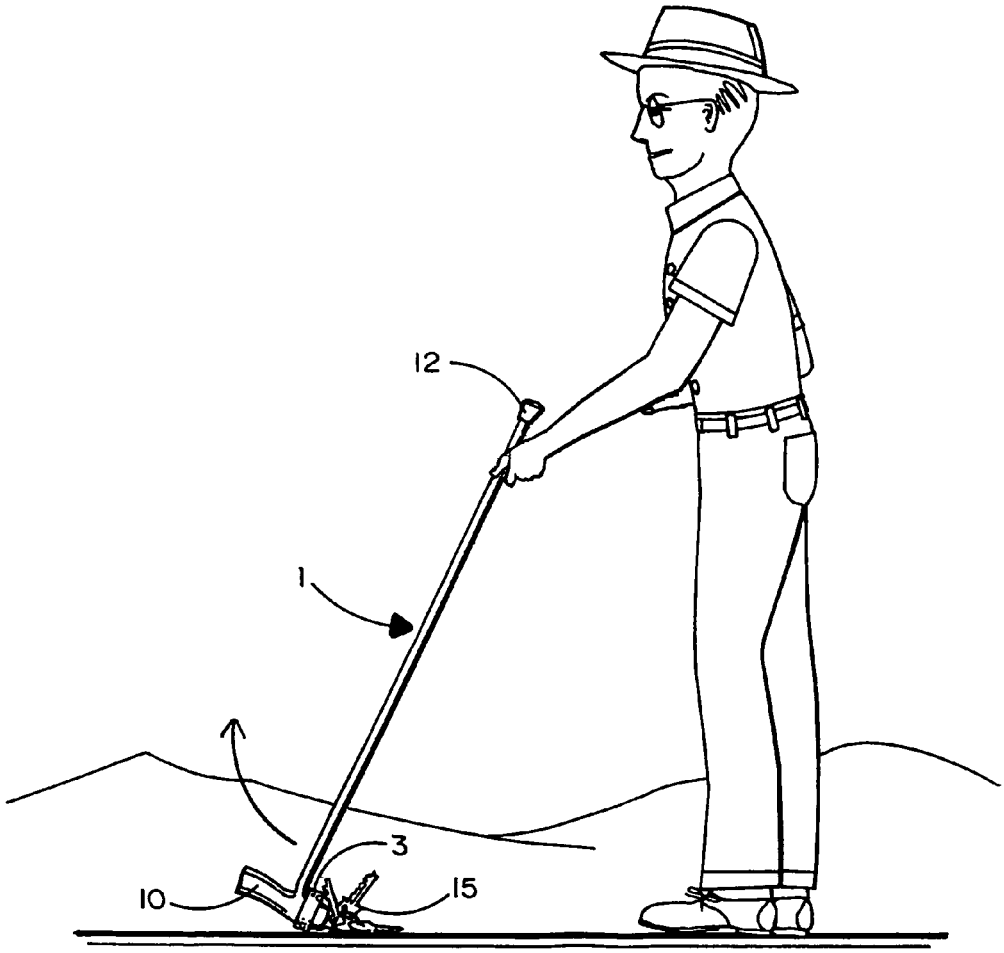
FIG. 1 shows an elderly and/or disabled individual holding a walking cane with a magnetic attachment coupled to the handle end thereof according to a first preferred embodiment to retrieve a set of keys that has fall on the floor.
Figure 2:
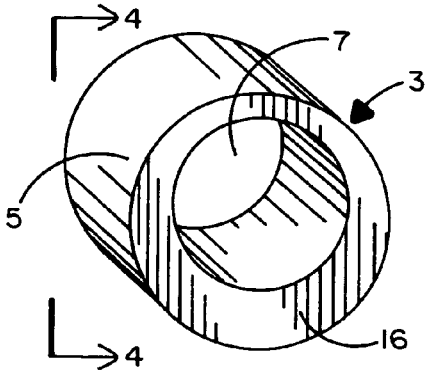
FIG. 2 is a perspective view of a coupling ring of the magnetic attachment shown in FIG. 1.
Figure 3:
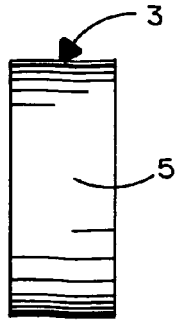
FIG. 3 is a side view of the coupling ring shown in FIG. 2.
Figure 4:
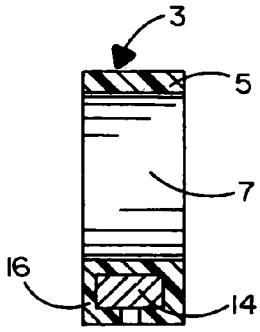
FIG. 4 is a cross section of the coupling ring taken along lines 4-4 of FIG. 2.
Figure 5:
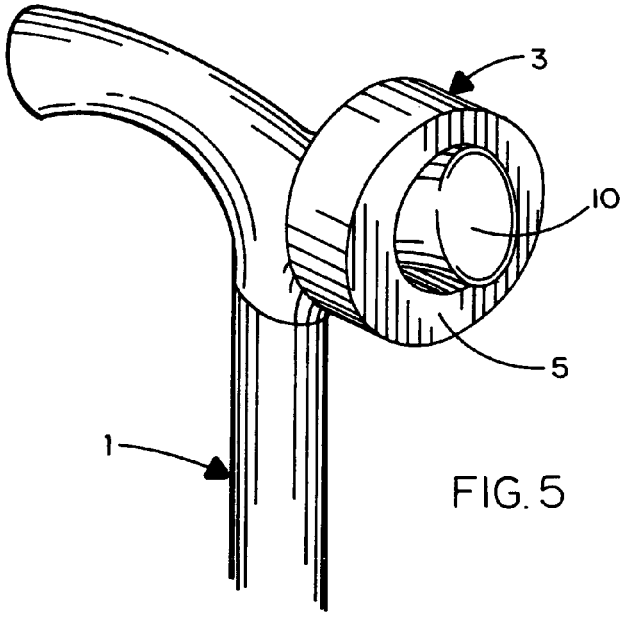
FIG. 5 is a detailed view showing the coupling ring of the magnetic attachment of FIG. 2 positioned in surrounding engagement with the handle end of a walking cane.

Referring initially to FIGS. 1-5 of the drawings, there is shown in FIG. 1 an individual using a conventional walking cane 1 to assist him in walking or standing. According to the present improvement, a magnetic attachment 3 (best shown in FIGS. 2-4) is detachably coupled to the cane 1 to allow the user to lift metal objects off the ground without having to kneel down or bend over. In the example of FIG. 1, the metal object to be attracted to the magnetic attachment 3 coupled to cane 1 is a set of keys 15. However, the combination walking cane 1 and magnetic attachment 3 can be used to lift other magnetic objects that are capable of being attracted to and held against a magnet in a manner that will soon be described. By virtue of using the combination cane 1 and magnetic attachment 3 herein disclosed, an elderly or disabled individual will not be as susceptible to the possibility of falling or sustaining a back injury while attempting to retrieve his dropped keys, or the like, as might otherwise occur as a consequence of having to kneel down or bend over.

According to the first preferred embodiment shown in FIGS. 1-5, the magnetic attachment 3 is a coupling ring or sleeve 5 having a cylindrical coupling channel 7 running longitudinally therethrough. The coupling channel 7 is sized to slidably receive the handle end (designated 10 in FIG. 5) at the top of the user's cane 1. By pushing the coupling ring 5 into surrounding engagement with the handle end 10 of cane 1, the magnetic attachment 3 is quickly and easily attached to the cane.

The magnetic attachment 3 may also be coupled to the opposite end of the user's cane 1 (not shown). In this case, the coupling ring 5 will be pushed into surrounding engagement with the butt end 12 at the bottom of the cane 1 (opposite the handle end 10). In either case, a pulling force applied to coupling ring 5 will cause the magnetic attachment 3 to be removed from the handle end 10 or butt end 12 at which time the magnetic attachment can be placed in the user's pocket or purse to await additional use in the future.

The coupling ring 5 of magnetic attachment 3 is preferably manufactured (e.g., molded) from a silicone rubber material. Coupling ring 5 is molded around a conventional magnet 14 (best shown in FIG. 4). Thus, one side 16 of the coupling ring 5 will be thicker than the other sides in order to accommodate the magnet 14 embedded therewithin. A silicone material and catalyst suitable for making the coupling ring 5 of magnetic attachment 3 is commercially available from Freeman Manufacturing & Supply of Akron, Ohio.

By turning his cane 1 upside down (as shown in FIG. 1), the user can move the magnetic attachment 3 carried by the handle end 10 into contact with his keys 15 or any other magnetic object to be lifted off the ground. The magnet 14 embedded within the coupling ring 5 of attachment 3 generates the force necessary to hold the keys 15 against the handle end 10 of cane 1. The user may then simply lift the cane 1 to his hand so as to grasp and remove the keys 15 from the handle end 10 thereof.

Figure 6:
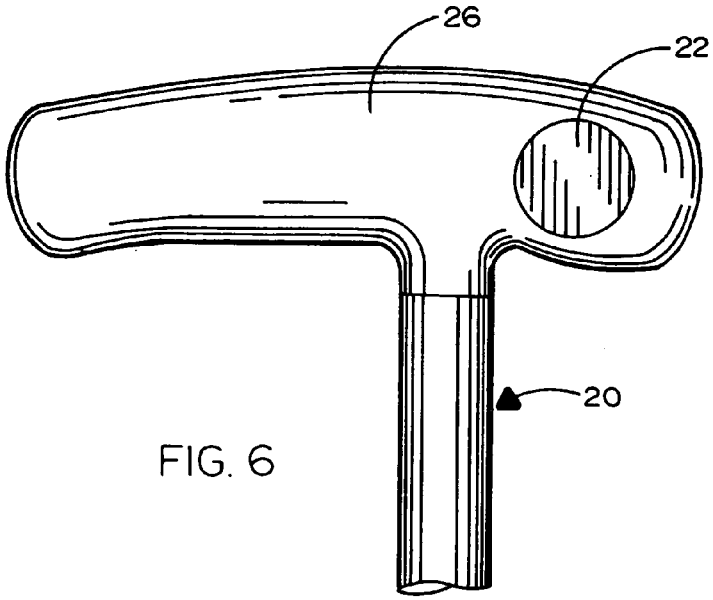
FIG. 6 shows a magnetic attachment according to a second preferred embodiment having a magnet affixed to the handle end of a walking cane at a hole formed therethrough.
Figure 7:
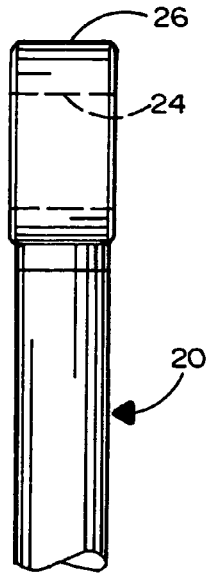
FIG. 7 is a side view of the handle end of the cane shown in FIG. 6 prior to the magnet being located in the hole formed therethrough.

Turning now to FIGS. 6 and 7 of the drawings, there is shown a second preferred embodiment for a magnetic attachment coupled to a conventional walking cane 20. Rather than being detachably coupled to the cane (as in the case of the magnetic attachment 3 of FIGS. 1-5), the magnetic attachment of FIGS. 6 and 7 is permanently affixed to and an integral part of the user's cane 20.

The magnetic attachment herein disclosed is a magnet 22 that is mounted within a hole (designated 24 in FIG. 7) that runs laterally through the handle 26 at the top end of cane 1. The magnet 22 may be frictionally engaged by the hole 24 and/or adhesively bonded therein. Moreover, while the hole 24 is shown in FIG. 7 as running completely through the handle end 26, the hole 24 may also be a recess that extends partially through the handle end. The magnet 22 coupled to the walking cane 20 is sized and shaped so as to conform to the size and shape of the hole 24 that is formed in the handle end 26. Thus, while magnet 22 is shown as having a cylindrical configuration to be received by a correspondingly cylindrical hole 24, the precise shape of the magnet is not to be regarded as a limitation of this invention.

Use of the magnetic attachment 22 shown in FIGS. 6 and 7 is similar to that described when referring to the magnetic attachment of FIGS. 1-5. More particularly, by turning his cane 20 upside down, the user can move the magnetic attachment 22 carried by the handle end 26 into contact with a magnetic object to be lifted off the floor. The magnet 22 secured within hole 24 generates the force necessary to hold a magnetic object against the handle end 26. The user may then simply lift the cane 20 to his hand so as to grasp and remove the magnetic object from the handle end 26 without having to bend over or kneel down.

The invention claimed is:

1. A device for walking, comprising:

a walking cane having a handle end to be grasped by the hand of a user; and a ring including a magnet embedded thereto, said ring being slidably and removably attached to said walking cane so as to surround the handle end thereof, such that when said handle end is moved into contact with a magnetic object, said object will be attracted to and held against said ring so as to be carried at said handle end.

2. The device for walking recited in claim 1, wherein said ring is detachable from said handle end of said walking cane in response to a pulling force applied thereto.

3. The device for walking recited in claim 1, wherein said ring is formed from a material that is molded over and around said magnet such that said magnet is embedded within said ring.

* * * * *